US005941426A

United States Patent [19]

Nagle et al.

[11] Patent Number: 5,941,426

[45] Date of Patent: Aug. 24, 1999

[54] LIQUID DISPENSING DEVICE

[76] Inventors: Jill C. Nagle, 1388 Haight St. #215, San Francisco, Calif. 94117; Kenneth Tarlow, 21 Golden Mind Pass., Corte Madera, Calif. 94925

[21] Appl. No.: 08/949,321

[22] Filed: Oct. 3, 1997

[51] Int. Cl.[6] ..... B67D 5/64

[52] U.S. Cl. ..... 222/167; 222/214; 222/538

[58] Field of Search ..... 222/160, 164, 222/167, 173, 180, 181.1, 181.2, 179.5, 214, 530, 533, 538, 183, 185.1

[56] References Cited

U.S. PATENT DOCUMENTS 4,905,873 3/1990 Loesel, Jr. et al. ..... 222/164

5,143,262 9/1992 Edlund ..... 222/181.2

5,413,251 5/1995 Adamson ..... 222/181.2

*Primary Examiner*—Philippe Derakshani

[57] ABSTRACT

A liquid or lotion container and dispensing device having a liquid bottle with a reservoir, a pump, and a liquid dispensing point. The pump forces liquid from the reservoir out the liquid dispensing point. The liquid bottle also has a supporting assembly. The supporting assembly supports the liquid bottle and allows the liquid bottle to pivot relative to the supporting assembly, and/or allows the liquid bottle to be detached and reattached to the supporting assembly.

18 Claims, 7 Drawing Sheets

LIQUID DISPENSING DEVICE

FIELD OF INVENTION

The present invention relates to dispensing bottles and more specifically to a dispensing bottle and associated bottle holder for liquids that can be operated with the same hand receiving the liquid being dispensed.

BACKGROUND OF THE INVENTION

Bottles having liquid dispensing means exist. These include bottles with pump heads, squeeze bottles and accordian shaped bottles that dispense when the pleated accordian members are compressed. All of the above discribed bottles require the user to provide the pumping action with one hand while using the other hand to receive the dispensed liquid.

There are however, situations where it would be advantageous for the user to be able to provide the dispensing action with the same hand that the liquid is being dispensed into. For example, a massage therapist may wish to dispense massage oil in his or her hand while maintaining contact with a person being massaged with the other hand. In many other case, it is ideal for the user to be able to dispense the desired liquid with the same hand that is receiving the liquid.

OBJECTS AND SUMMARY OF THE PRESENT INVENTION

It is an object of the present invention to solve the above stated problem by providing a dispensing bottle in which a user can both dispense and receive the contents of the liquid being dispensed with one hand. This is accomplished by providing a bottle shape which contains a pumping means activated by the users thumb while the remaining four fingers fit in a cupped shaped position under the dispensing head. In one embodiment of the present invention, the liquid dispensing bottle is attached by one end to a base plate or bottle holding cradle. The point of attachment for the bottle to the base plate allows for the bottle to pivot or rotate out from the base plate. Stoppers built into the base plate/bottle can hold the bottle in either a fully closed position up against the base plate, or in an open position of approximately thirty degrees out from the base plate. Once the bottle has been rotated out from its closed position and locked into the open position, the user presses a button located on the top upper portion of the bottle with his or her thumb while catching the dispensed liquid emanating from a dispensing point located on the under side of the upper portion of the bottle with the remaining four fingers. Another object of the present invention is to provide a liquid dispensing bottle whose base is of a concave shape to accommodate irregular surfaces such as bed covers or blankets. Another object of the present invention is to provide a liquid dispensing bottle in which the bottle portion can be lowered onto the base portion when not in use. It is another object of the present invention to provide a liquid dispensing bottle which is detachable and reattachable to its base plate or bottle holding cradle. These and other objects will be described in the drawings and description of drawings which follow.

GENERAL DESCRIPTION OF THE DRAWINGS

DETAILED DESCRIPTION OF THE DRAWINGS

Figure 1:
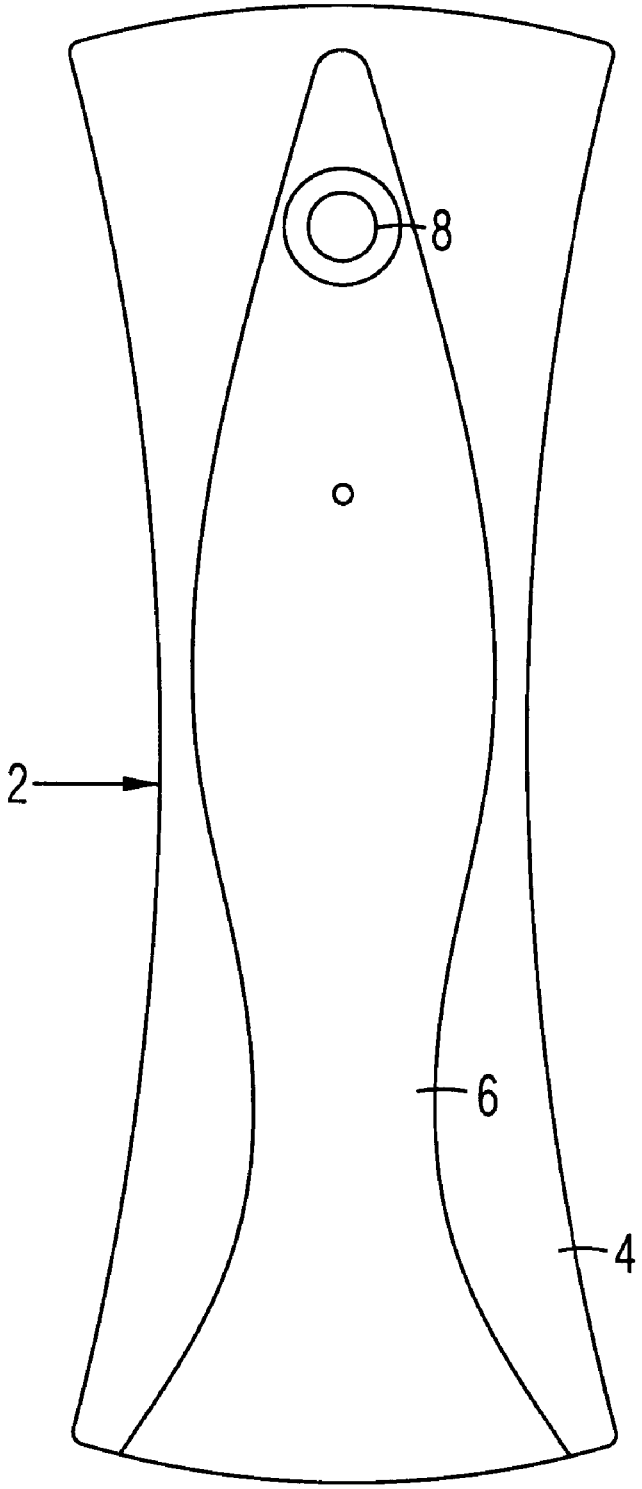
FIG. 1 is a top view of the liquid dispensing bottle and bottle holder of the present invention.
Figure 2:
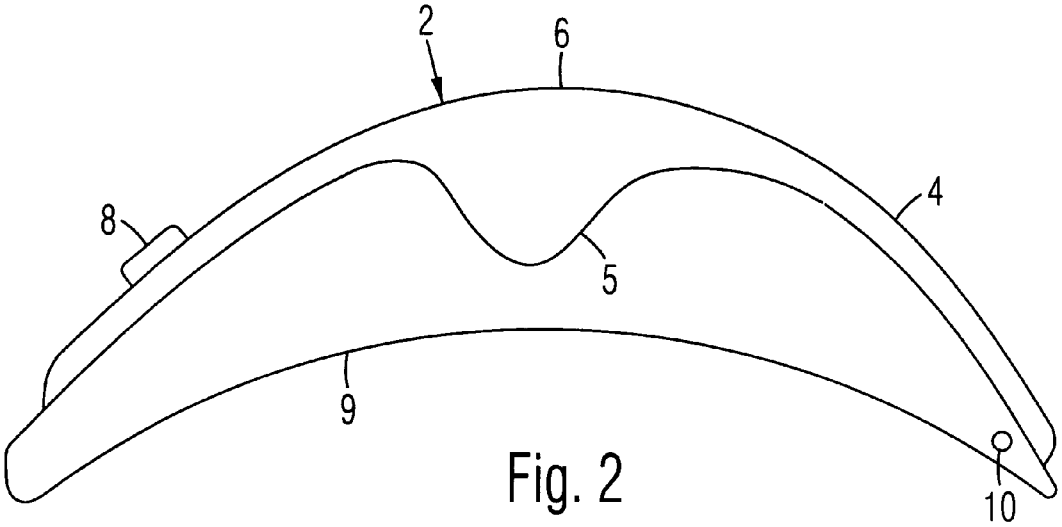
FIG. 2 is a side view of the liquid dispensing bottle and bottle holder of the present invention.
Figure 3:
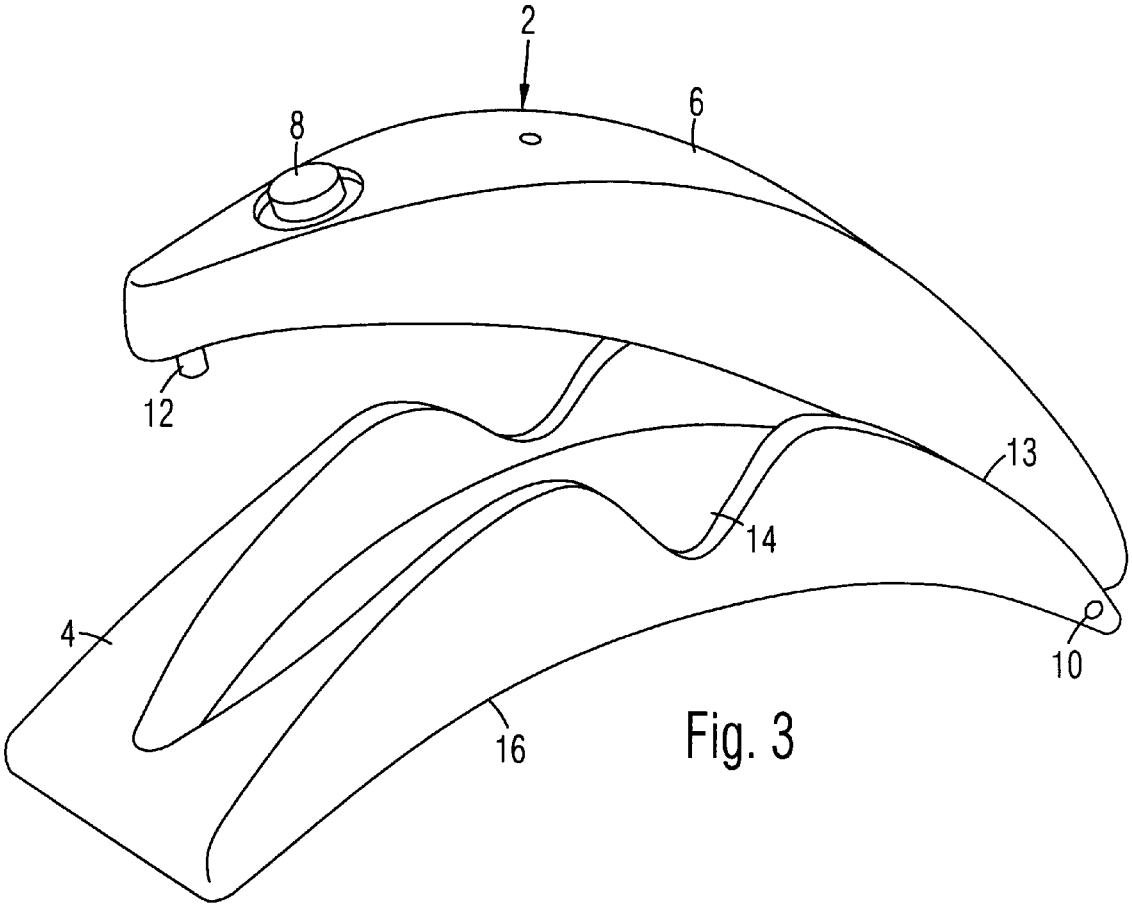
FIG. 3 is a perspective view of the liquid dispensing bottle and bottle holder of the present invention in the open position.
Figure 4:
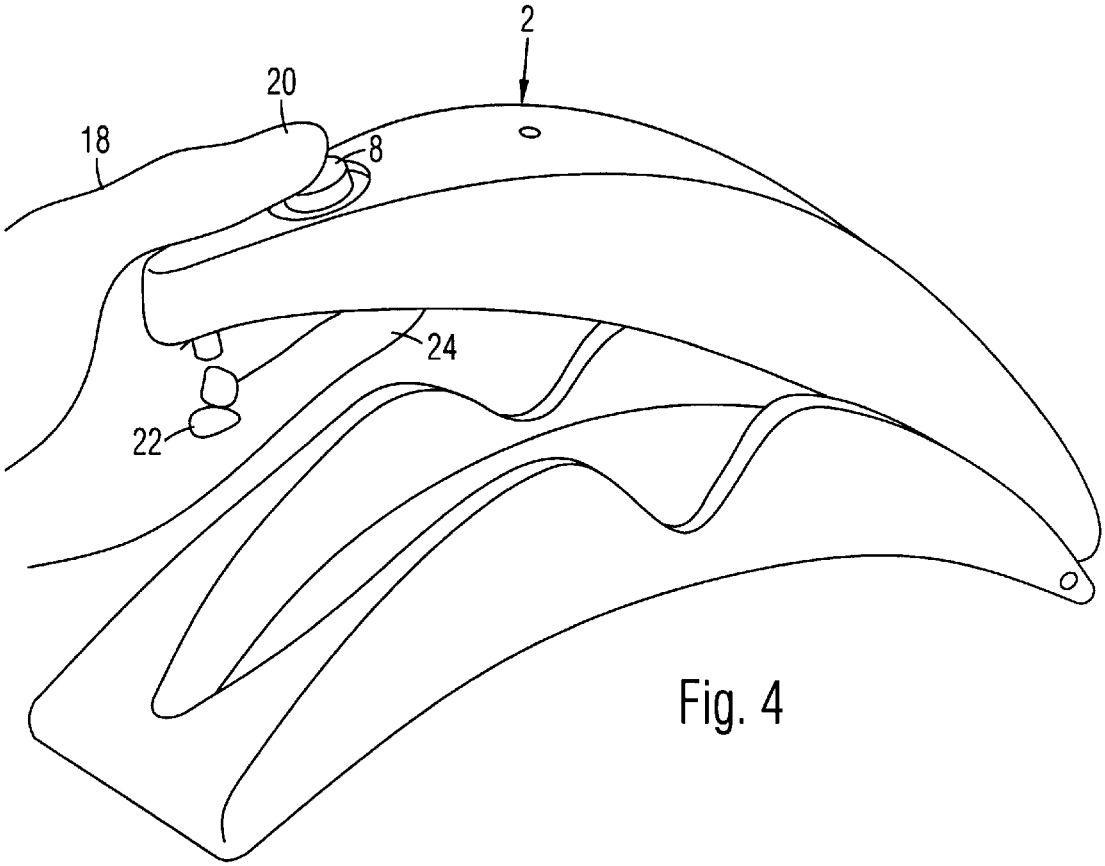
FIG. 4 is a perspective view of a user dispensing liquid from the present invention.

Reffering now to FIG. 1 we see a top view of the present invention where bottle portion 6 nests into holder portion 4. FIG. 2 shows a side view of the present invention in the closed position. The cut out portion 5 of holder 4 allows a user to lift bottle 6 out of the holder using the thumb and forefinger. The concave curve of the bottom of holder 4 allows the unit to rest on irregular surfaces. FIG. 3 shows the bottle portion in the use position. Bottle portion 6 pivots about shaft 10 and locks in place because of a friction fit between bottle side 13 and the inner wall of holder 4. FIG. 4 shows a user dispensing a liquid from the dispensing bottle by pushing with the thumb 20 on button 8 causing liquid 22 to dispense into the users hand 24. Note that the dispensing and liquid receiving action is accomplished with one hand.

Figure 5:
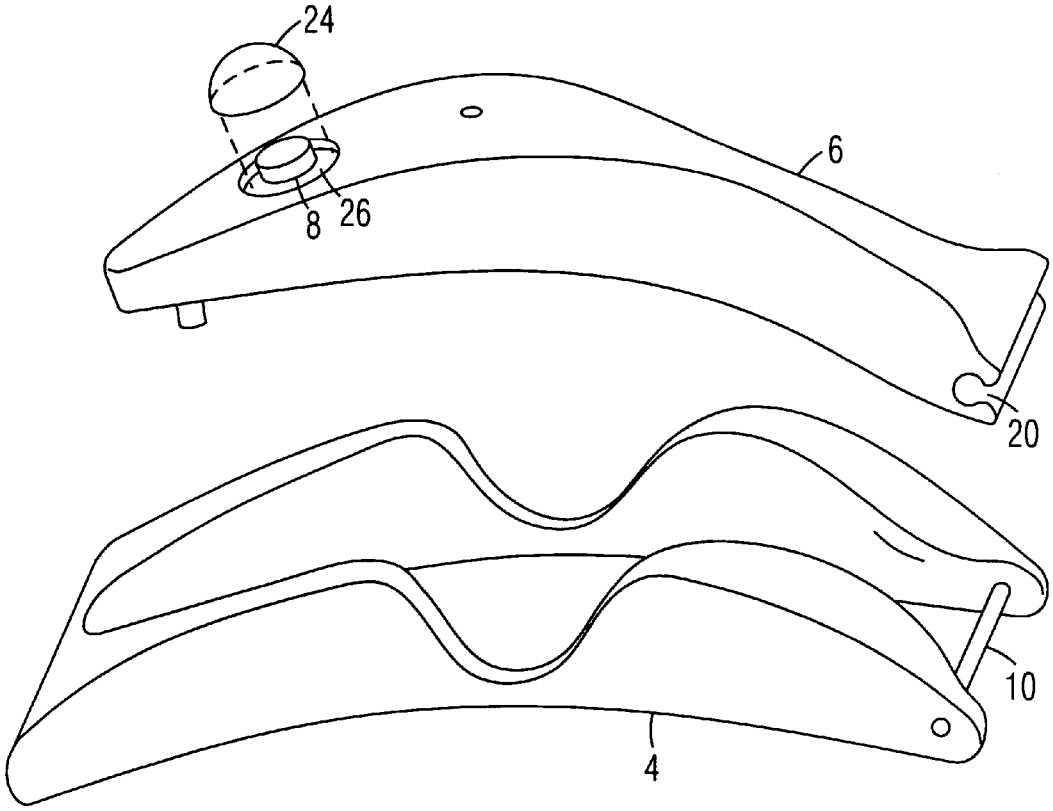
FIG. 5 is an exploded view of the bottle and the bottle holder of the present invention.
Figure 6:
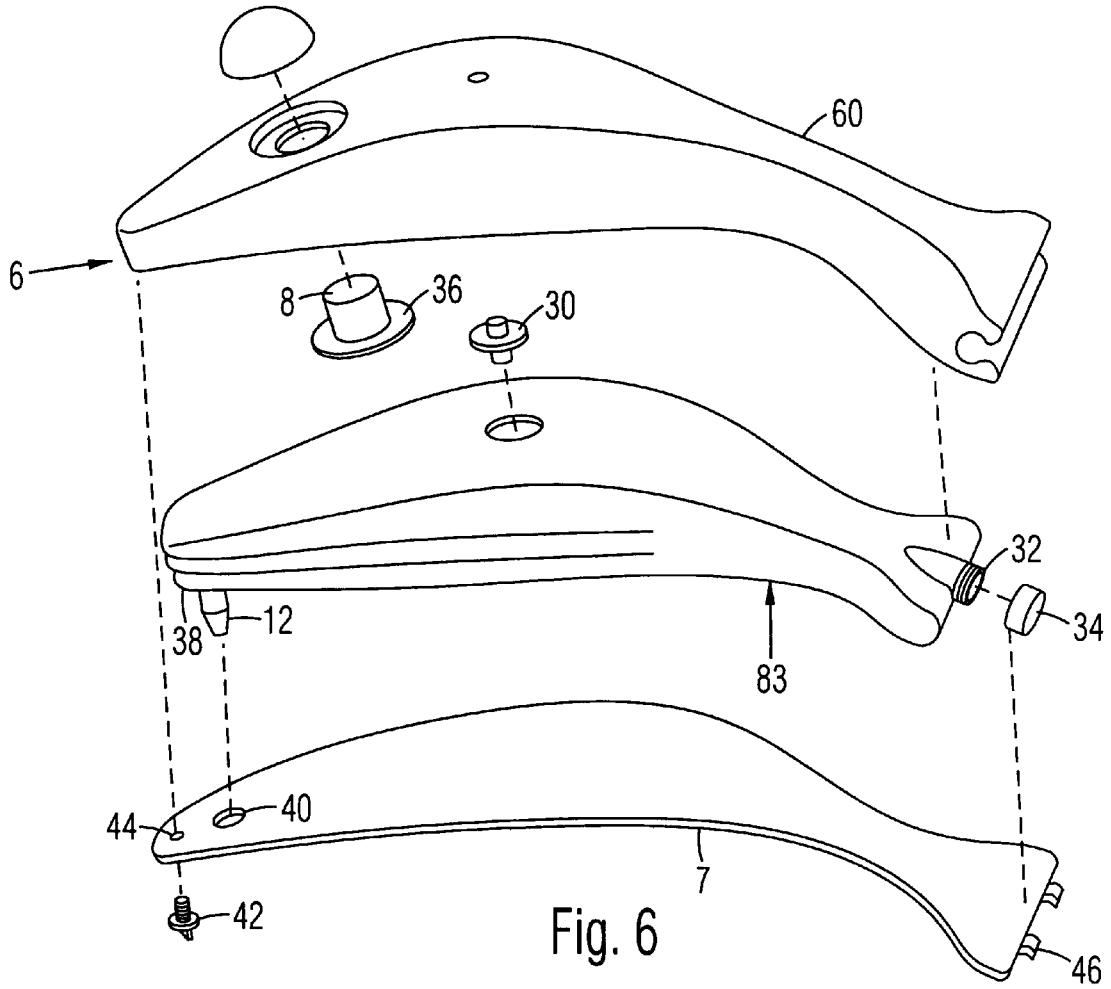
FIG. 6 is an exploded view of the bottle of the present invention.
Figure 7:
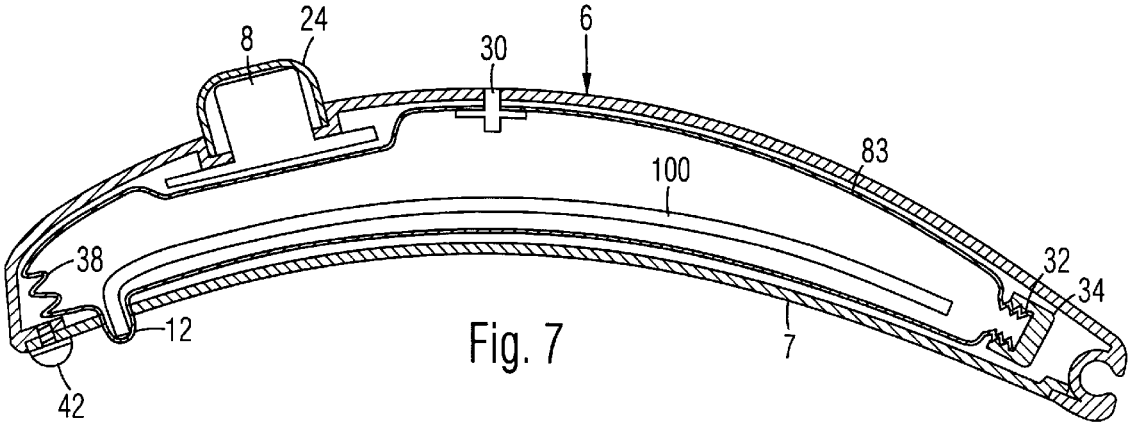
FIG. 7 is a side section view of the bottle of the present invention.

FIG. 5 shows the dispensing bottle of the present invention 6 separated from holder 4. Channel area 20 of bottle 6 snaps off of hinge pin 10 of holder 4. Cap 24 can be used to cover push button 8 so that when a person is transporting the bottle 6 in a purse or other confined space, the push button 8 is not accidentally activated. Cover 24 snaps into recess 26 by means of a friction fit. FIG. 6 shows an exploded view of dispenser bottle 6. Outer cover 60 is molded of rigid plastic. Reservoir bottle 83 is made of blow molded resilient plastic. Button 8 terminates at its bottom in a wide flange 36. When a user pushes down on button 8 pressure is put on reservoir bottle 83. Accordian pleats 38 allow the bottle 83 to compress thereby forcing liquid contents out of duck bill check valve 12. Check valve 30 allows air to flow into bottle 83 as the bottle returns to its expanded position. The natural spring qualities of the blow molded plastic of bottle 83 allows the bottle 83 to automatically return to its expanded position. Liquid is poured into bottle 83 through opening 32 and closed off by cap 34. Rigid plate 7 acts to close off the bottle assembly 6. Flanges 46 hold one end in place and thumb screw 42 holds the other end in place. FIG. 7 shows a section view of bottle assembly 6. In this view tube 100 can be seen which attaches at one end to duck bill check valve 12 and is free at its opposite end. Since bottle assembly 6 is in a slanted position when in use, tube 100 insures that most of the liquid contained in reservoir bottle 83 will be dispensed. FIG. 7 also shows air inlet check valve 30 which allows air to enter the reservoir during the return stroke of bellows 38

Although the above drawings and description of the drawings is a preferred embodiment it is to be understood that there may be other embodiments of the present invention but which never the less fall within the scope and spirit of the present invention. For example, rather than bottle portion 6 being hinged about shaft 10 of holder 4, the two assemblies 6 and 4 could be one fixed assembly with bottle assembly 6 permanently mounted in the slanted, use position. Additionally, the bellows type pump mechanism described could be replaced be a more conventional spring loaded check valve pump assembly as found in standard liquid soap dispensers.

Therefore I claim:

1. A liquid dispensing bottle and bottle supporting assembly comprised of a liquid holding bottle, a bottle supporting means and a liquid pumping means, said bottle oriented in a slanted position of approximately thirty degrees having at its lower end attached to a bottle holding means and its upper end free to allow a users thumb to press said liquid pumping means causing said liquid to pour out of said liquid holding bottle and said users other four fingers and palm to receive said liquid wherein said liquid holding bottle is hinged at its lower end to said bottle holding means so that said liquid holding bottle can swing down and nest into said bottle holding means or swing up into the use position.

2. A liquid container and dispensing device as claimed in claim 1 further comprising: a set of stopper features which use friction and contact with said liquid holding bottle and said bottle supporting assembly to secure said liquid holding bottle in a plurality of positions relative to said bottle supporting assembly.

3. A liquid container and dispensing device as claimed in claim 1 wherein said liquid holding bottle can be detached and reattached to said bottle supporting assembly at said bottle supporting end.

4. A liquid container and dispensing device as claimed in claim 1 wherein said bottle supporting assembly has a bottom surface which is concave in shape.

5. A liquid container and dispensing device as claimed in claim 3 wherein said bottle supporting assembly has a bottom surface which is concave in shape.

6. A liquid container and dispensing device as claimed in claim 1 further comprising: a set of stopper features which use friction and contact with said liquid holding bottle and said bottle supporting assembly to secure said liquid holding bottle in a first position relative to said bottle supporting assembly.

7. A liquid container and dispensing device as claimed in claim 3 further comprising: a set of stopper features which use friction and contact with said liquid holding bottle and said bottle supporting assembly to secure said liquid holding bottle in a first position relative to said bottle supporting assembly.

8. A liquid container and dispensing device as claimed in claim 4 further comprising: a set of stopper features which use friction and contact with said liquid holding bottle and said bottle supporting assembly to secure said liquid holding bottle in a first position relative to said bottle supporting assembly.

9. A liquid container and dispensing device as claimed in claim 5 further comprising: a set of stopper features which use friction and contact with said liquid holding bottle and said bottle supporting assembly to secure said liquid holding bottle in a first position relative to said bottle supporting assembly.

10. A liquid container and dispensing device as claimed in claim 3 further comprising: a set of stopper features which use friction and contact with said liquid holding bottle and said bottle supporting assembly to secure said liquid holding bottle in a plurality of positions relative to said bottle supporting assembly.

11. A liquid container and dispensing device as claimed in claim 4 further comprising: a set of stopper features which use friction and contact with said liquid holding bottle and said bottle supporting assembly to secure said liquid holding bottle in a plurality of positions relative to said bottle supporting assembly.

12. A liquid container and dispensing device as claimed in claim 5 further comprising: a set of stopper features which use friction and contact with said liquid holding bottle and said bottle supporting assembly to secure said liquid holding bottle in a plurality of positions relative to said bottle supporting assembly.

13. A liquid dispensing bottle and bottle supporting assembly comprised of a liquid holding bottle, a bottle supporting means and a liquid pumping means, said bottle oriented in a slanted position of approximately thirty degrees having at its lower end attached to a bottle holding means and its upper end free to allow a users thumb to press said liquid pumping means causing said liquid to pour out of said liquid holding bottle and said users other four fingers and palm to receive said liquid wherein said liquid holding bottle can detach and reattach to said bottle supporting means.

14. A liquid container and dispensing device as claimed in claim 13 wherein said bottle supporting assembly has a bottom surface which is concave in shape.

15. A liquid container and dispensing device as claimed in claim 13 further comprising: a set of stopper features which use friction and contact with said liquid holding bottle and said bottle supporting assembly to secure said liquid holding bottle in a first position relative to said bottle supporting assembly.

16. A liquid container and dispensing device as claimed in claim 14 further comprising: a set of stopper features which use friction and contact with said liquid holding bottle and said bottle supporting assembly to secure said liquid holding bottle in a first position relative to said bottle supporting assembly.

17. A liquid container and dispensing device as claimed in claim 13 further comprising: a set of stopper features which use friction and contact with said liquid holding bottle and said bottle supporting assembly to secure said liquid holding bottle in a plurality of positions relative to said bottle supporting assembly.

18. A liquid container and dispensing device as claimed in claim 14 further comprising: a set of stopper features which use friction and contact with said liquid holding bottle and said bottle supporting assembly to secure said liquid holding bottle in a plurality of positions relative to said bottle supporting assembly.

* * * * *